US006729830B2

(12) United States Patent
Wagner et al.

(10) Patent No.: US 6,729,830 B2
(45) Date of Patent: May 4, 2004

(54) WHEELED WORK MACHINE AND FRAME ASSEMBLY

(75) Inventors: Oryn B. Wagner, Bismarck, ND (US); Jeffrey A. Dahl, Lincoln, ND (US); Michael J. Henline, West Fargo, ND (US)

(73) Assignee: Clark Equipment Compnay, Woodcliff Lake, NJ (US)

( * ) Notice: Subject to any disclaimer, the term of this patent is extended or adjusted under 35 U.S.C. 154(b) by 0 days.

(21) Appl. No.: 09/977,092

(22) Filed: Oct. 12, 2001

(65) Prior Publication Data

US 2003/0070329 A1 Apr. 17, 2003

(51) Int. Cl.[7] ..... E02F 3/38
(52) U.S. Cl. ..... 414/686
(58) Field of Search ..... 414/487, 685–688, 414/699, 700, 546, 549–555, 565, 595, 587; 180/89.12, 291, 292; 280/760, 762, 769

(56) References Cited

U.S. PATENT DOCUMENTS

| | | | | |
|---|---|---|---|---|
| D30,069 | S | 1/1899 | Allen | |
| D46,614 | S | 10/1914 | Willis | |
| 2,362,994 | A | 11/1944 | Frost | 214/78 |
| D140,591 | S | 3/1945 | Hollmann et al | D14/3 |
| D142,365 | S | 9/1945 | Cooke | D14/3 |
| 2,429,170 | A | 10/1947 | Royle | 214/78 |
| 2,457,400 | A | 12/1948 | Roos | 180/48 |
| 2,459,473 | A | 1/1949 | Troutman | 214/78 |
| RE23,166 | E | 11/1949 | Owen | 214/78 |
| D163,884 | S | 7/1951 | Mandt | D14/3 |
| 2,569,053 | A | 9/1951 | Healy | 214/111 |
| 2,712,876 | A | 7/1955 | Kuehn, Jr. | 214/78 |
| 2,818,983 | A | 1/1958 | Freni | 214/78 |
| 2,845,192 | A | 7/1958 | Klaus | 214/78 |
| 3,356,240 | A | 12/1967 | Zink | 214/501 |
| 3,378,094 | A | 4/1968 | Myers | 180/64 |
| 3,472,405 | A | 10/1969 | Bowman et al. | 214/501 |
| 3,601,958 | A | 8/1971 | Roof | 56/13.7 |
| 3,672,521 | A | 6/1972 | Bauer et al. | 214/145 |
| 3,732,996 | A | 5/1973 | Bauer | 214/152 |
| 3,811,581 | A | 5/1974 | Van Der Lely | 214/131 |
| 4,023,690 | A | 5/1977 | Goode | 214/146.5 |
| D245,606 | S | 8/1977 | Williams | D12/162 |
| 4,056,204 | A | 11/1977 | Spasuik | 214/83.3 |
| D249,663 | S | 9/1978 | Willett | D12/60 |
| 4,698,150 | A | 10/1987 | Wigoda | 209/421 |
| 4,787,811 | A | 11/1988 | Langenfeld et al. | 414/723 |
| 4,828,071 | A | 5/1989 | Gaede | 180/291 |
| 5,308,220 | A | 5/1994 | Schaeff | 414/699 |
| 5,468,120 | A | 11/1995 | Krob | 414/695 |
| 5,509,770 | A | 4/1996 | Burenga | 414/24.6 |
| D370,684 | S | 6/1996 | Johnson | D15/32 |
| 5,647,441 | A | 7/1997 | Gibbons | 172/439 |

(List continued on next page.)

FOREIGN PATENT DOCUMENTS

| | | |
|---|---|---|
| GB | 874825 | 8/1961 |
| GB | 1381091 | 1/1975 |
| WO | WO 0127397 | 1/2001 |
| WO | WO 0129328 | 4/2001 |

*Primary Examiner*—Robert E. Pezzuto
(74) *Attorney, Agent, or Firm*—Westman, Champlin & Kelly, P.A.; S. Koehler

(57) ABSTRACT

A wheeled work machine includes a rigid frame assembly having a support with a boom pivot. A front wheel assembly is joined to the frame assembly proximate the support, while a rear wheel assembly is joined to the frame assembly at an end remote from the support. The frame assembly further supports an engine, operator platform and cargo support. The operator platform is supported by the frame assembly between the boom pivot and the engine, while the cargo support is disposed behind the operator platform.

42 Claims, 14 Drawing Sheets

U.S. PATENT DOCUMENTS

| | | | | | |
|---|---|---|---|---|---|
| 5,660,217 | A | | 8/1997 | Nissley | 144/24.12 |
| D386,769 | S | | 11/1997 | Gibbons | D15/23 |
| 5,778,569 | A | | 7/1998 | Schaeff | 37/410 |
| 5,975,216 | A | | 11/1999 | Gibbons | 172/439 |
| 5,984,618 | A | | 11/1999 | Deneve et al. | 414/722 |
| 6,012,272 | A | * | 1/2000 | Dillon | 56/14.6 |
| 6,047,749 | A | | 4/2000 | Lamb | 144/24.12 |
| D431,574 | S | | 10/2000 | Porter | D15/25 |
| D432,145 | S | | 10/2000 | Kraft et al. | D15/30 |
| D433,689 | S | | 11/2000 | Kraft et al. | D15/30 |
| D442,972 | S | | 5/2001 | Wolf | D15/15 |
| D449,055 | S | | 10/2001 | Guiet | D15/28 |
| D457,174 | S | | 5/2002 | Bissell | D15/28 |
| D459,368 | S | | 6/2002 | Westendorf et al. | D15/32 |
| 6,446,879 | B1 | * | 9/2002 | Kime | 239/7 |
| D464,661 | S | | 10/2002 | Dahl et al. | D15/23 |
| D465,228 | S | | 11/2002 | Dahl et al. | D15/23 |
| D466,135 | S | | 11/2002 | Spomer et al. | D15/33 |

* cited by examiner 10
14
16
39
34
38
50
42
49
94
44
136
32
160
48
130
12
26
30
134
24
146
28
94
147
153
132
151
145

100
28
26
16
38
34
94
64
60
50
36
14
158
18
32
30
24
12
20
94
94

16
34
56
58
38
54
60
70
50
52
74
42
64
47
32
48

WHEELED WORK MACHINE AND FRAME ASSEMBLY

BACKGROUND OF THE INVENTION

The present invention relates to power machinery. More particularly, the present invention relates to an overall configuration or layout of a wheeled work machine.

Although compact tractors, skid steer loaders and other types of wheeled work machines have enjoyed great success and are used throughout the world in a number of different applications, these machines are not well suited for all work environments. For example, compact tractors, while useful in some applications, frequently have a number of characteristics, which limit their usefulness in some applications. Typically, compact tractors have poor visibility to the front (i.e., toward the bucket). Compact tractors also typically have limited hydraulic systems for operation of attachments, and the attachments are frequently behind the operator, forcing the operator to turn around to see them. Further, for the operator of the compact tractor, entry/egress is often awkward or difficult and usually the tractor only provides seating for a single person. Also, compact tractors lack a cargo area, which severely limits their usefulness in many applications. Other common limitations of compact tractors include a relative lack of stability and the rough ride provided by many compact tractor designs.

Utility carts are another type of wheeled work machine, which have a number of characteristics that limit their usefulness in some applications. For example, utility carts do not have a loader option, and typically have limited or no attachment capability. Also, utility carts generally have limited, if any, onboard hydraulic systems for the operation of hydraulic attachments. Other typical characteristics of utility carts, which limit the applications in which they can be used, include a relatively large turning diameter and a limited ability to carry cargo. Utility carts are frequently low on power needed to pull equipment or carry cargo.

In many applications, a small turning diameter would be a beneficial feature of a wheeled work machine. However, many wheeled work machines, if not most, do not have small turning diameters. Thus, to change direction of travel, these machines need to stop, change direction, reorient the machine, and proceed in the intended direction. Typically, machines with front steerable wheels (for example, tractors and most utility vehicles) have to maintain a short wheelbase in order to maintain a small turning diameter, as wheelbase and turning diameter are inversely proportional. However, a short wheelbase has a negative effect by decreasing stability, lift capacity, operator area, cargo area, etc.

Most compact tractors maintain a relatively small turning diameter by turning the front wheels extremely sharply and generally by having a shorter wheelbase. Turning the wheels excessively sharp can be damaging to sensitive grounds such as lawns and turf areas. Further, even with a short wheelbase (and the disadvantages which result), the relatively small turning diameter of compact tractors may not be small enough for some applications. Most utility carts have a large turning diameter, which is unacceptable for many applications, due to the fact that they cannot turn the wheels as sharply as a typical tractor and that they require a longer wheelbase to place the operator platforming, engine, cargo area, etc. A wheeled work machine which provides a small turning diameter without the disadvantages associated with the short wheelbase of tractors, would be a significant improvement in wheeled work machine applications.

Generally, wheeled work machines such as compact tractors, utility carts, and other types have numerous limitations, which prevent them from being suited for some applications. Some of these limitations are discussed above with reference to compact tractors and utility vehicles, but they may apply to other types of work machines as well. In addition to turning diameter characteristics, a common limitation in many wheeled work machines is a general inability to carry more than one person to a work site. Other limitations include an inability to carry cargo, poor visibility, lack of attachments such as a bucket or loader, low power, and instability, to name a few.

Skid steer loaders have proven to be highly useful in many applications. Skid steer loaders have features, which are often highly beneficial for certain work environments. For example, skid steer loaders can support a wide variety of work tools and attachments. Skid steer loaders can also be turned very sharply. Numerous other features of skid steer loaders provide these machines with highly advantageous capabilities.

Although skid steer loaders have enjoyed great success and are used throughout the world in a number of different applications, the skid steer loader is not well suited for all work environments.

There is thus a continuing need for an improved wheeled work machine. A machine that addresses one, several or all of the deficiencies discussed above would be particularly advantageous.

SUMMARY OF THE INVENTION

A wheeled work machine includes a rigid frame assembly having a support with a boom pivot. A front wheel assembly is joined to the frame assembly proximate the support, while a rear wheel assembly is joined to the frame assembly at an end remote from the support. The frame assembly further supports an engine, operator platform and cargo support. The operator platform is disposed between the boom pivot and the engine, while the cargo support is disposed behind the operator platform.

DETAILED DESCRIPTION OF THE PREFERRED EMBODIMENT

Figure 1:
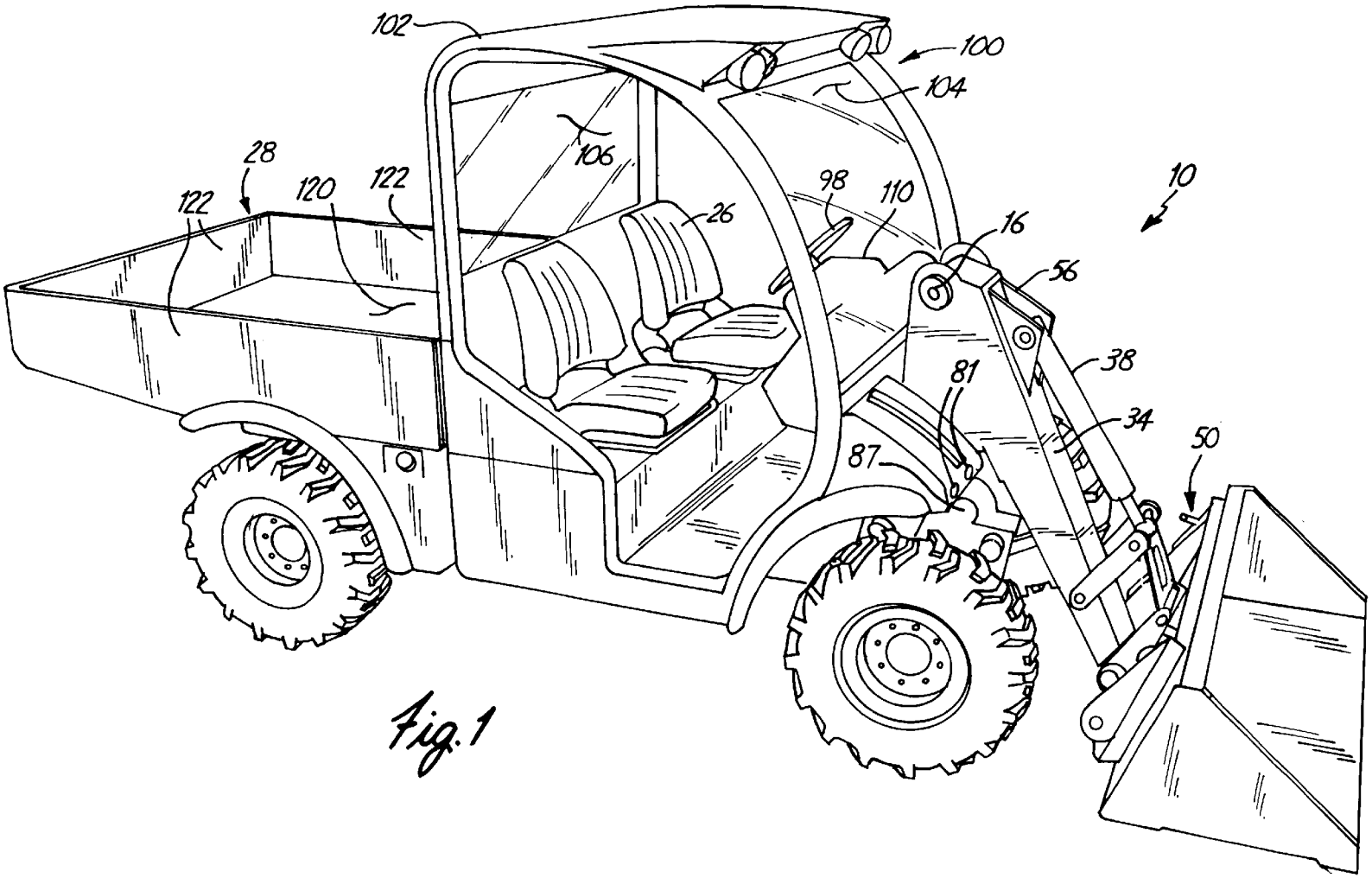
FIG. 1 is a perspective view of a wheeled work machine of the present invention.
Figure 2:
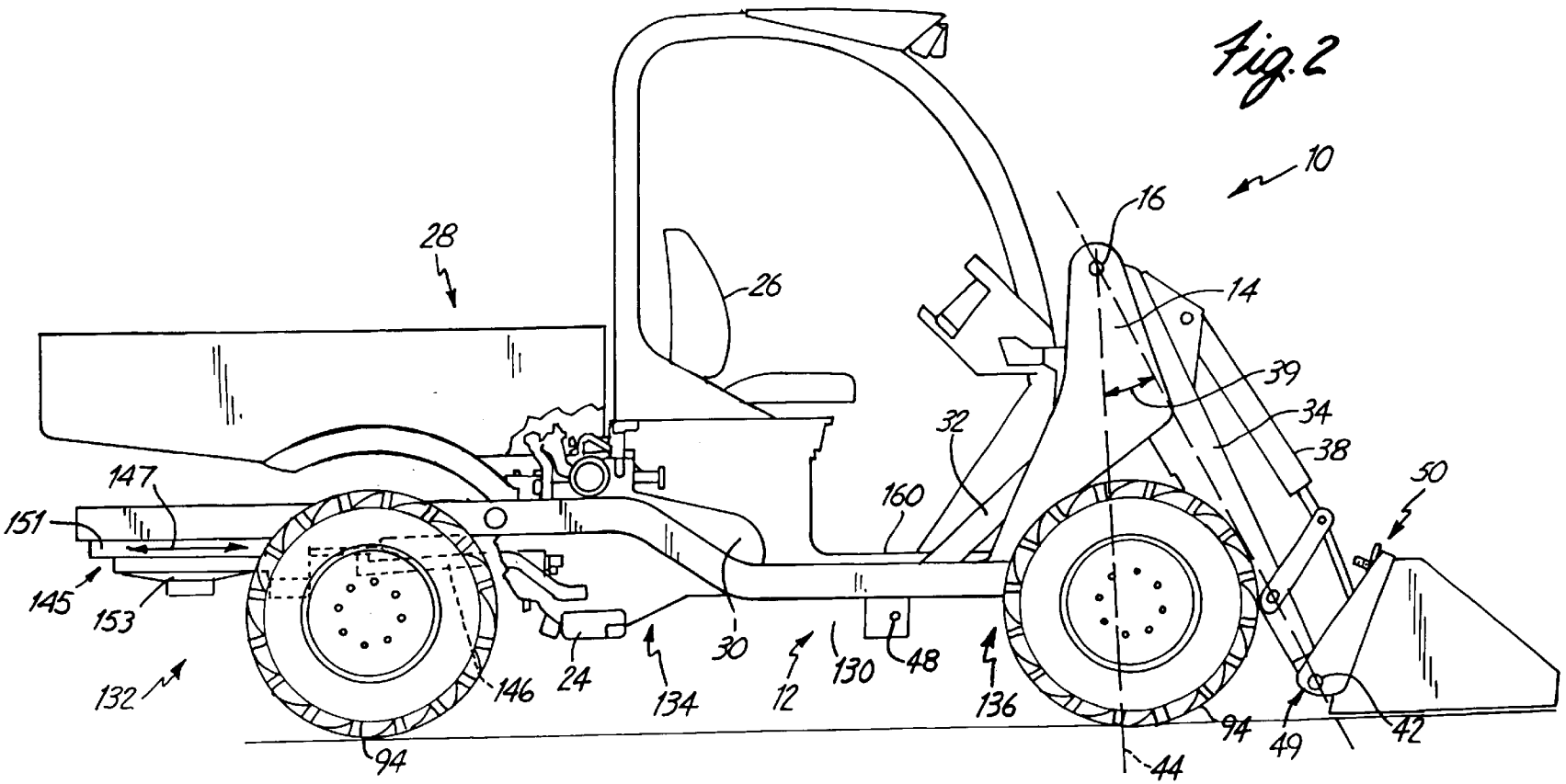
FIG. 2 is a side elevational view of the wheeled work machine with portions removed.
Figure 3:
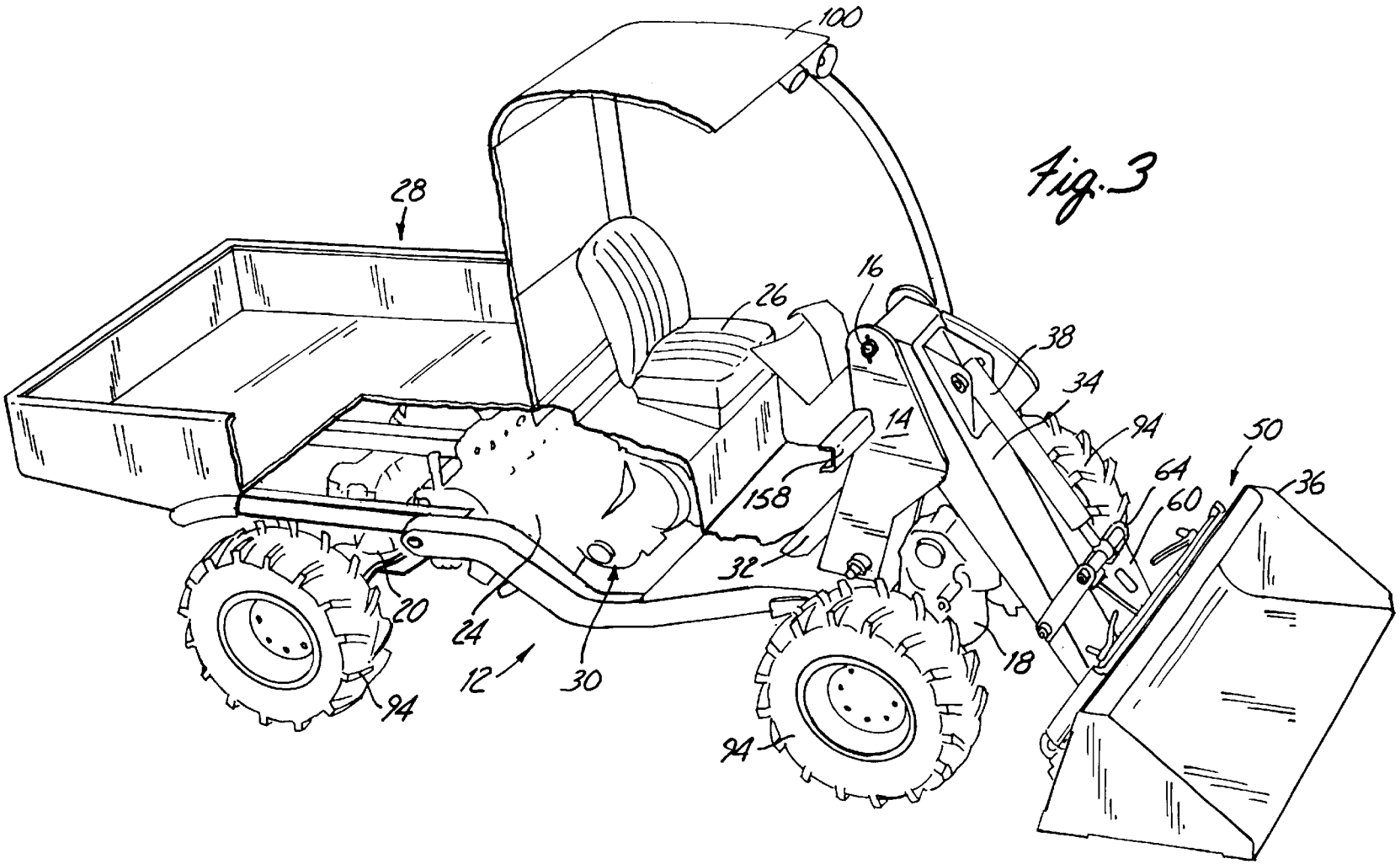
FIG. 3 is a perspective view of the wheeled work machine with portions removed.

An exemplary embodiment of a wheeled work machine 10 of the present invention is illustrated in FIGS. 1, 2 and 3.

The wheeled work machine 10 includes a rigid frame assembly 12 having a support 14 with a boom pivot 16. A front wheel assembly 18 is joined to the frame assembly 12 proximate the support 14. Similarly, a rear wheel assembly 20 is joined to the frame assembly 12 at an end thereof remote from the support 14.

The wheeled work machine 10 further includes an engine 24, an operator platform 26 (herein embodied as a seat) and a cargo support 28.

Location of these elements in combination with the support 14 for the boom pivot 16 provides a unique, multipurpose machine that is compact and usable in a number of different applications. In particular, the operator platform 26 is located behind the support 14 and between the boom pivot 16 and the engine 24. In addition, the cargo support 28, which is also supported by the frame assembly 12, is located behind the operator platform 26 and, in one embodiment, over at least a portion of the engine 24. In the embodiment illustrated, the engine 24 is coupled to a hydraulic pump 30, which in turn, is coupled to a lift cylinder 32. Under selective control by the operator, the lift cylinder 32 can be used to tilt a lift arm 34 that is pivotally coupled at the boom pivot 16. In a manner discussed below, various tools can be attached to the lift arm 34 to perform various work functions at a position convenient for forward viewing by the operator sitting in operator platform 26. For instance, as illustrated, a bucket 36 can be coupled to a remote end 49 of the lift arm 34 and used to scoop or lift various types of materials. As illustrated and discussed below, a tilt cylinder 38 can also be coupled between the lift arm 34 and the bucket 36, which allows the bucket 36 to be pivoted relative to the lift arm 34. It should be noted however that the bucket 36 is but one exemplary tool that can be used with the wheeled work machine 10. However, as another aspect of the present invention, the wheeled work machine 10 includes a single lift arm or boom 34 pivotally joined to the boom pivot 16. Use of a single lift arm 34 provides a stable, strong lifting device, but also minimizes obstruction to the remote end of the lift arm 34 as viewed by the operator sitting in operator platform 26. Nevertheless, although illustrated as a single lift arm 34, those skilled in the art can appreciate that additional lift arms can be used, for instance, in a side-by-side relationship from the support or supports 14 disposed in front of the operator platform 26, and therefore, this configuration is also considered part of the present invention.

As illustrated, the lift arm 34 extends between a line between wheels of the front wheel assembly 18. In one embodiment, a minimum angle 39 formed between the boom pivot 16 and a second boom pivot 42 typically provided at a remote end of the lift arm 34 and a normal reference line 44 from the boom pivot 16 to a level ground surface is in the range of 20 to 35 degrees and in a further embodiment in the range of 22–28 degrees.

Using a rigid lift arm 34 between pivots 16 and 42 enables the bucket 36 to move forwardly during lifting from the initial angle 39 described above. The forward movement of the bucket 36 allows a less-experienced operator to easily fill the bucket 36 without requiring the wheeled work machine 10 to move forward during lifting. Due to the path taken by the bucket 36, the bucket 36 is filled during, approximately, the first 65 degrees of travel. Although many forms of loaders have the capability to raise a loaded bucket, many do not have the required traction or power to push the bucket completely into a pile of heavy material. Likewise, because many buckets lift primarily vertically, due to the long extension of the booms or lifting arms, many machines do not have the ability to lift a full bucket through the material that is above the bucket in view that that bucket was driven into the pile. In contrast, the large forward component of bucket movement during lifting enables the bucket 36 to be easily filled with rotation of the lift arm 34. In one embodiment, the lift arm 34 pivots through an arc of 102 degrees from its initial starting position. In this manner, once the bucket 36 is filled, the bucket 36 moves away from the pile of material. The use of a single boom support 14 and a single lift arm 34 is particularly beneficial because this construction enables a compact assembly of the work machine 10 and also provides excellent viewing of the remote end of the lift arm 34 for the operator sitting in the operator platform 26.

In a preferred embodiment, the height of the pivot 16 with respect to a level ground surface is in the range of 48 to 54 inches, for example, 50.94 when angle 39 is 27.5°. Other dimensions include the position of pivot 42 with respect to pivot 16 (55 to 49 inches, preferably 51.83 when angle 39 is 27.5°) and the height of pivot 42 above the ground (2 to 8 inches, preferably 5 inches when angle 39 is 27.5°). Similarly, the position of pivot 48 with respect to pivot 16 is in the range of 42.5 to 48.5 inches, preferably 45.5 when angle 39 is 27.5°, and the height of pivot 48 above the ground is in the range of 9 to 15 inches, preferably 12 when angle 39 is 27.5°. Likewise the position of the lift cylinder connection (pivot 47) to lift arm 34 with respect to pivot 16 is 13 to 19 inches, preferably 16 when angle 39 is 27.5°, while the length of the lift arm 34 (from pivot 16 to pivot 42) is also 49 to 55 inches, preferably 51.83 when angle 39 is 27.5°.

As discussed above, the lift cylinder 32 is operably coupled between the frame 12 and the lift arm 34 to pivot the lift arm 34. In a further embodiment, the remote end 49 (FIG. 6) of the lift arm is joined, for example, pivotally, to the frame assembly 12 between the wheel assemblies 18 and 20 to provide a compact assembly. In this manner, the front wheel assembly 18 is disposed between the lift arm 34 and the lift cylinder 32. Use of a single lift cylinder 32 in the center of the wheeled work machine 10 also minimizes any damage thereto.

In the embodiment illustrated, a quick attachment interface member or assembly 50 is provided at the remote end of the lift arm 34 forward of the operator platform 26, which is a far more convenient position of the tool at the end of the lift arm 34. The quick attachment interface 50 has been utilized extensively by Bobcat Company and sold under the trade name BOBTACH. The interface assembly 50 allows quick attachment of various work tools such as buckets, grapples, brooms, augers or the like. In this manner, by including the interface 50, the work machine 10 can readily accept and use all of the various types of work tools currently in use or developed in the future.

Figure 6:
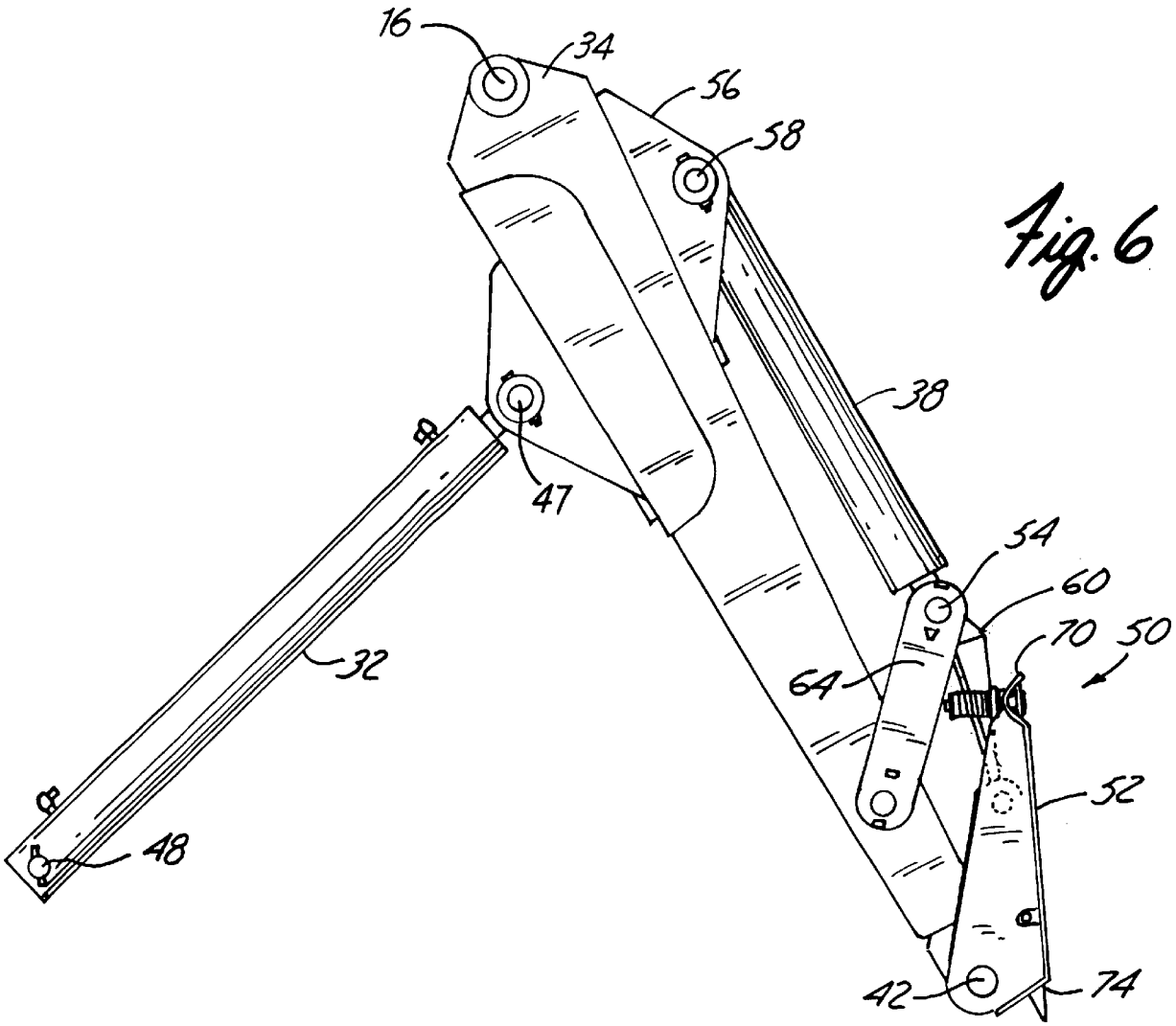
FIG. 6 is a side elevational view of a lift arm assembly.
Figure 7:
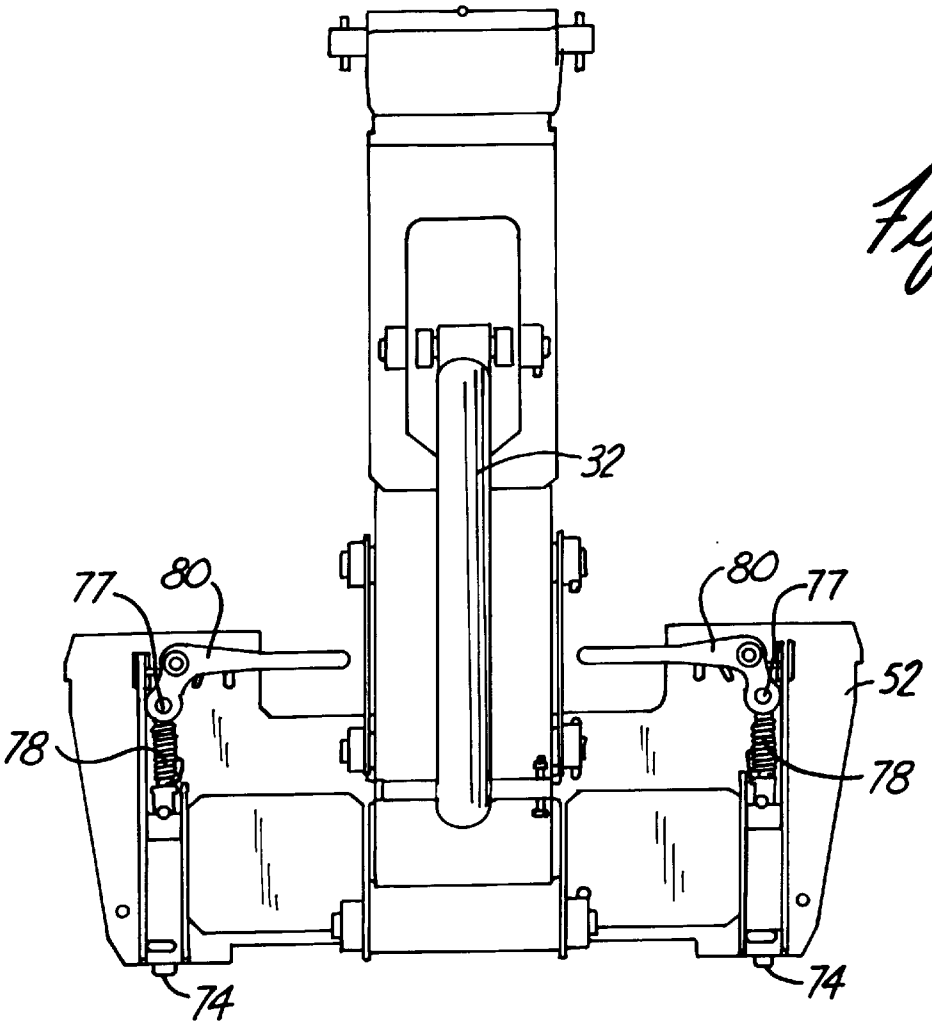
FIG. 7 is a rear elevational view of the lift arm assembly.
Figure 8:
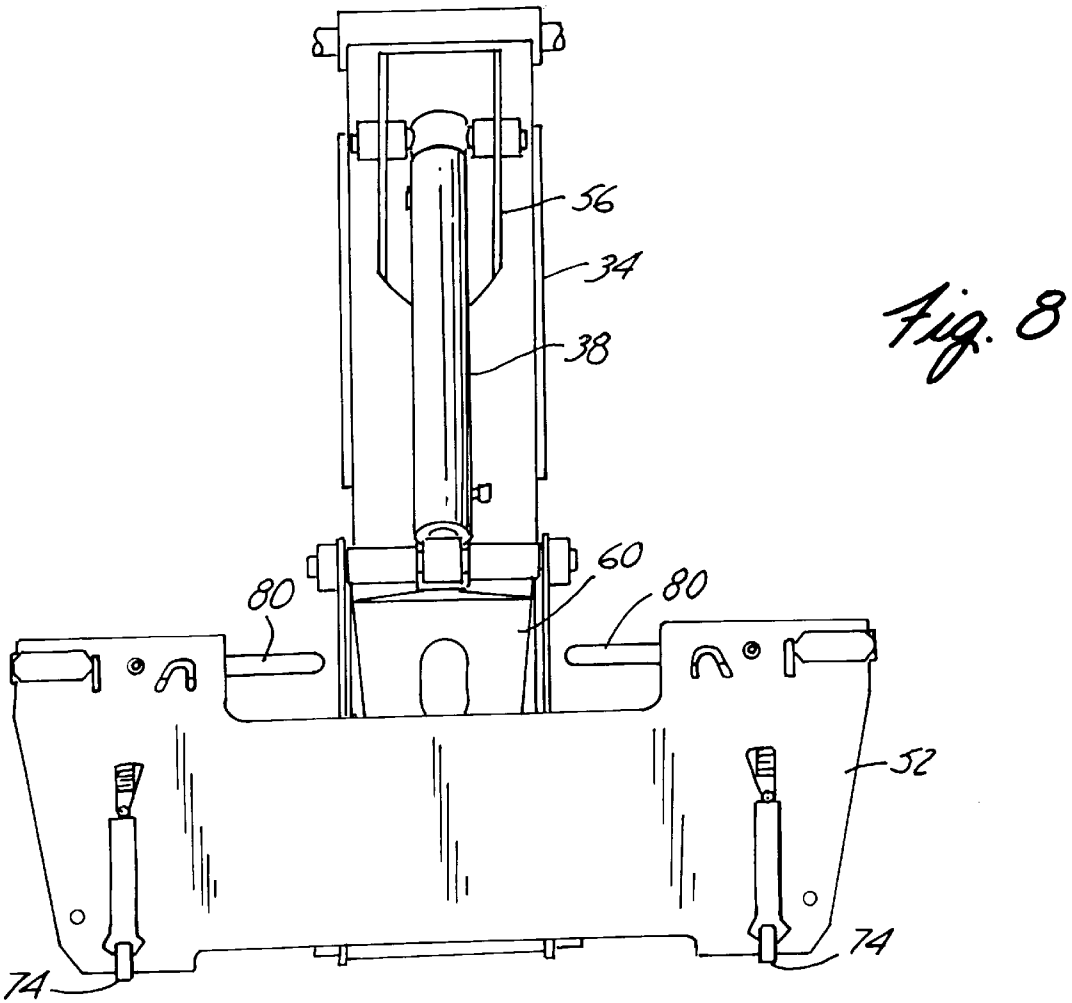
FIG. 8 is a front elevational view of the lift arm assembly.

Referring to FIGS. 6, 7 and 8, the interface 50 includes an attachment plate 52 pivotally attached to the second pivot 42. The tilting of the attachment plate 52 is controlled by the tilt cylinder 38, which is operably coupled between the lift arm 34 and the attachment plate 52. In the embodiment illustrated, a bracket 56 is provided with a pivot 58 to which an end of the tilt cylinder 38 is coupled. A second end 54 of the tilt cylinder 38 is operably coupled to the interface 50, and in the embodiment illustrated, through a link 60 that is pivotally coupled to the attachment plate 52. A standoff support 64 is also pivotally coupled to the lift arm 34 and to a common pivotal connection between the tilt cylinder 38 and the link 60.

Typically, the attachment plate 52 includes a lip 70 that will fit under a flange on an attachment or work tool such as the bucket 36. As is well known, apertures provided on the work tool will align with apertures of the attachment plate 52, or at least sliding wedges 74 provided on the attachment plate 52. The wedges 74 move linearly on the attachment plate 52. Typically, each of the wedges 74 have a tapered wedge end to aid in pushing the wedge into the desired aperture on the attachment plate 52 or work tool when it is in position to be mounted. A spring 78 joins each of the wedges 74 to a corresponding lever 80 that is pivotally connected to the attachment plate 52. The arrangement is conventional and the levers 80 and spring 78 will load each corresponding wedge 74 downward to lock the wedge 74 as well as upward in an unlocked position. An actuator end of each of the levers 80 carry pivot pins 77 for the springs 78. Handles are provided on each of the levers 80 in order to allow manual operation. A power actuator such as disclosed in U.S. Pat. No. 5,562,397 can also be provided, if desired.

Some work tools or attachments couplable to the interface 50 can be powered or operated hydraulically. The work machine 10 can include hydraulic couplings that are fluidly coupled to the pump 30 through suitable control valves or the like. The couplings can be provided at or near the interface 50 and/or proximate the support 14, for example, on the work machine body at 81 (FIG. 1). Likewise, if desired, hydraulic couplings can be provided at the rear of the work machine proximate the cargo support 28.

Figure 5:
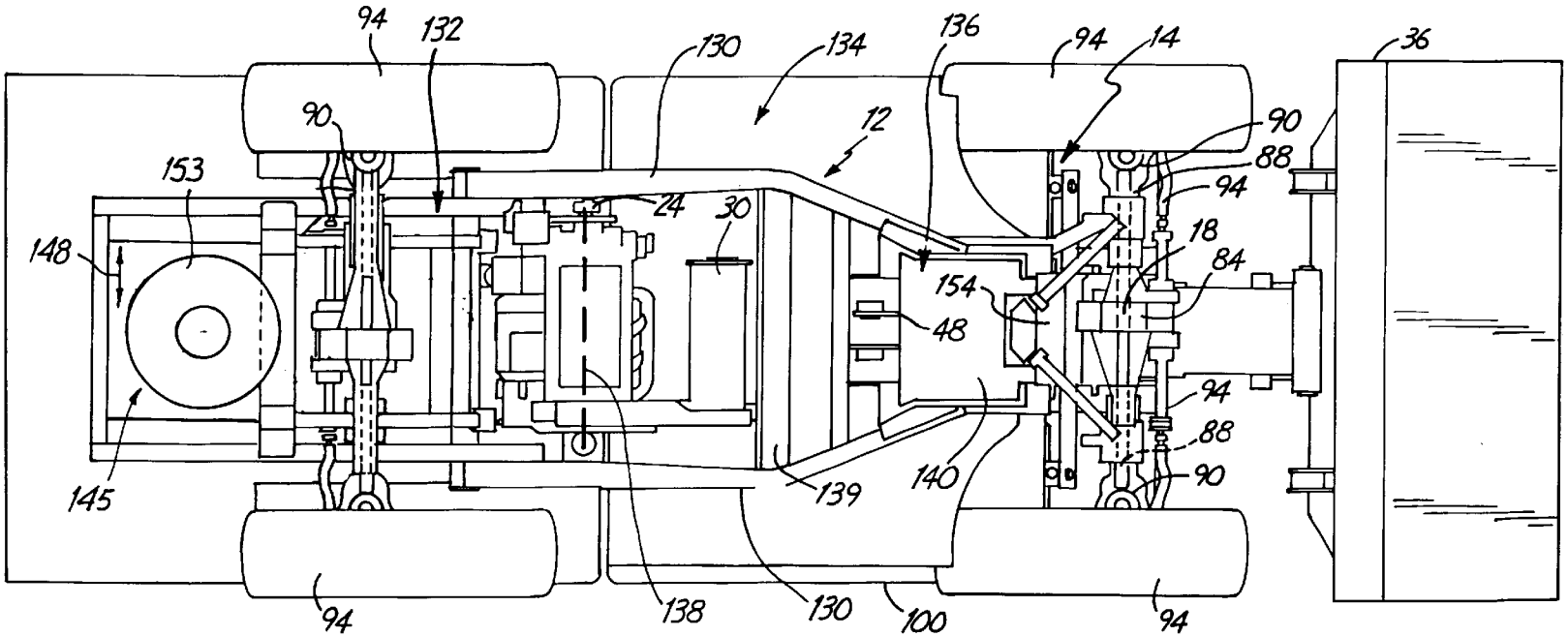
FIG. 5 is a bottom plan view of the wheeled work machine.

Referring to FIGS. 3 and 5, movement of the work machine 10 is provided by wheels 94 mounted on each of the wheel assemblies 18 and 20. Either or both of the wheel assemblies 18 and 20 can be powered by the engine 24, for example, by mechanical drive shafts, chains, belts or the like. In the embodiment illustrated, hydraulic drive motors are mounted to the housing assemblies 84, which in turn, drive the wheels 94. The drive housing assemblies 84 can be independent, i.e., one for any chosen wheel 94, or as illustrated, have opposed output shafts 88 to drive a pair of wheels 94.

The drive housing assemblies 84 can include gear reduction, wet disk brake, differential, differential lock and the output shafts 88. In one embodiment as illustrated, pivotal couplings 90 are provided at the ends of the drive housing assemblies 84 and are coupled to hub assemblies of the wheels 94 to allow the associated wheels 94 to pivot. Tie rods 94 coupled to a suitable steering mechanism having a steering wheel 98 (FIG. 1) proximate the operator platform 26 can control pivotal motion of the wheels 94. In the embodiment illustrated, each of the wheel assemblies 18 and 20 allow the corresponding wheels 94 to be pivoted providing for all-wheel steering capability resulting in a small turning diameter. Nevertheless, in an alternative embodiment, the steering mechanism can be coupled to only the front wheel assembly 18, or to only the rear assembly 20.

The steering mechanism for the front and/or rear wheels 94 can take any number of forms such as a mechanical linkage between the steering wheel 98 and the steerable wheels of the front wheel assembly 18 and/or rear wheel assembly 20. In the embodiment illustrated, the wheels are steered using hydraulic cylinders mounted to the drive housings. There can be a steering cylinder for each steerable wheel, or pairs of wheels can be steered with a single cylinder and a tie rod connection. The steering wheel 98 can be coupled to a steering sector to direct pressurized hydraulic fluid to the appropriate steering cylinders thus obtaining steering of the desired wheels. The steering modes can illustratively include front wheel steer, rear wheel steer, coordinated steer (in which the front and rear wheels are steered in pairs in opposite directions to implement tighter turns) and crab steer (in which the front rear wheels are again steered in pairs but in the same direction). A control valve can be further used in the hydraulic circuit of the rear wheels, wherein the control valve receives an input related to the type of steering desired for the rear wheels, e.g. coordinated or crab steer, and properly directs pressurized to the steering actuator based on the desired mode of steering. Allowing the work machine 10 to steer all of the wheels 94 significantly minimizes damage to the ground surface, which can occur during travel to the work site or operation of the work machine 10 at the job site.

In one embodiment, multiple seat positions can be provided through individual seats, as illustrated, or a common bench seat. Configured in this manner, the work machine 10 allows side-by-side seating positions for the transportation of two or more individuals to the job site. It should be further noted that the operator platform 26 is disposed on the frame assembly 12 between the wheel assemblies 18 and 20 so as to provide a stable platform. In the embodiment illustrated, the operator platform 26 forms part of an operator station 100 that can include a canopy 102. An exemplary construction of side panels for the operator station 100 is described in co-pending application "Side Panel Assembly for Wheeled Work Machine", Ser. No. 09/977,110, filed Oct. 15, 2001. A windshield 104, back window 106 and doors (not shown) can also be provided in order to enclose the operator station 100, if desired.

An instrument cluster and dash 110 is generally disposed in front of the operator platform 26 and behind the boom pivot 16 and includes gauges, controls and the like for operation of the work machine 10. The instrument cluster and dash 110 is also disposed at a level such that an upper surface thereof allows an operator of height in the range of a female in the fifth percentile to a male in the ninety-fifth percentile to view an end of the lift arm 34 remote from the boom pivot 16.

The cargo support 28 located behind the operator platform 26 and supported by the frame assembly 12 allows the transportation of tools and/or other material to the job site. Although exemplified herein as a cargo box (open or enclosed), which can also tilt through a suitable lift cylinder and hinge coupling the cargo box to the frame assembly 12, which has a floor 120 and side walls 122 (with or without tailgates or side gates), the cargo support 28 can include other forms of containers or platforms. For instance, the cargo support can also include a sprayer having a suitable tank for containing liquid, a hopper such as for spreading sand, or a plurality of tool boxes to name a few.

Referring FIGS. 2 and 5, engine 24 is generally located behind operator platform 26 and below cargo support 28. In one embodiment, a transverse engine is supported by the frame assembly 12 at this location. The transverse engine 24 includes a crank shaft indicated by dashed line 138 oriented transversely with respect to a longitudinal axis (front to back) of the work machine 10. Although other orientations of engine 24 can be used, the transverse engine provides a compact assembly that can also be easily serviced.

Also shown in FIGS. 2, 4, 5 and 14 is a radiator assembly 145 for cooling engine 24. Radiator assembly 145 is supported at least partially beneath cargo support 28 by longitudinal frame members 130. In one embodiment, longitudinal frame members 130 are C-channel frame members (see for example FIG. 9). In these embodiments, radiator assembly 145 can be supported via positioning between, and within the C-channels of, frame members 130.

In the embodiment illustrated, radiator assembly 145 is supported by longitudinal frame members 130 behind the rear axle. This is shown in the Figs. by placement of the radiator assembly behind rear wheel 94 or suspension assembly 180.

Radiator assembly 145 includes a radiator 151 and optionally one or more air flow generation device 153 such as a fan or other blower for removing heat energy by moving air past radiator 151. In the illustrated embodiments, radiator assembly 145 includes dual fans or air flow generation devices 153, with one positioned on top of radiator 151, and one positioned below radiator 151. In other embodiments, radiator assembly 145 and air flow generation devices 153 can be positioned elsewhere. Radiator assembly 145 also includes hoses 146 which carry coolant between engine 24 and radiator 151. Also, radiator assembly can include other features, for example an airflow redirecting structure or mechanism which redirects airflow from fans 153 toward the rear of the wheeled work machine in order to minimize dust in the area of operator station 100.

Radiator 151 is supported relative to longitudinal frame members 130 and the ground in a "flat" position in order to further facilitate the compact design of wheeled work machine 10. In other words, radiator 145 has a vertical dimension relative to the ground which is less than its longitudinal dimensions indicated generally at 147 and 148 in FIGS. 2, 4, 5 and 14. Generally, radiator 151 is oriented with its longitudinal dimensions substantially parallel to the ground to give it a low profile. However, radiator 151 can also be oriented at slight angles relative to the ground, for example up to about 45° or less to create the exhaust. Including a flat radiator 151 for cooling of engine 24 allows the radiator to be supported by longitudinal frame members 130 beneath cargo support 28. In addition to saving space and facilitating a compact and stable wheeled work machine configuration, utilization of a flat radiator assembly 145 placed in this position can also serve to protect the radiator from damage relative to other potential locations on the wheeled work machine.

Figure 9:
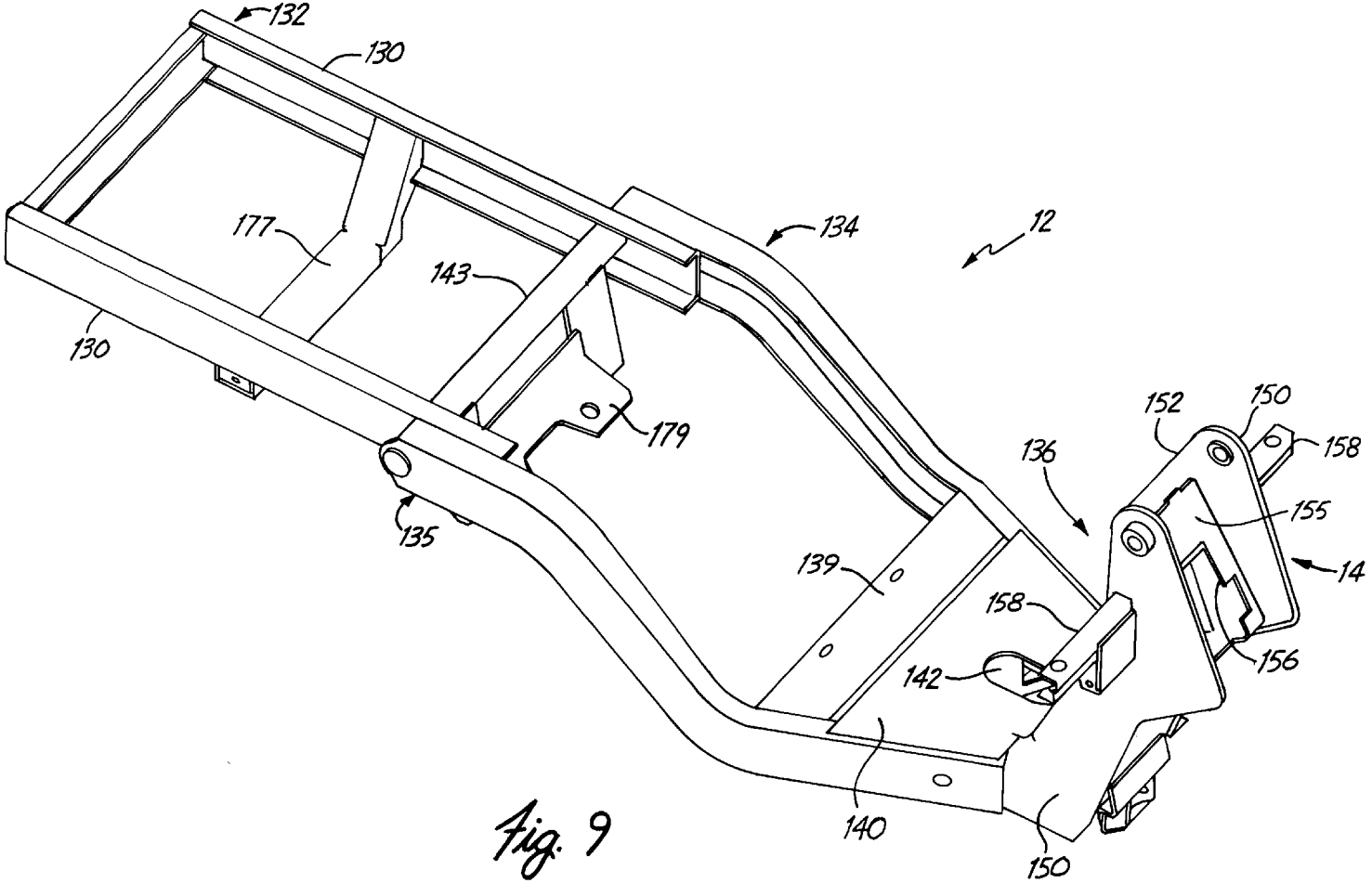
FIG. 9 is a perspective view of a frame assembly.
Figure 10:
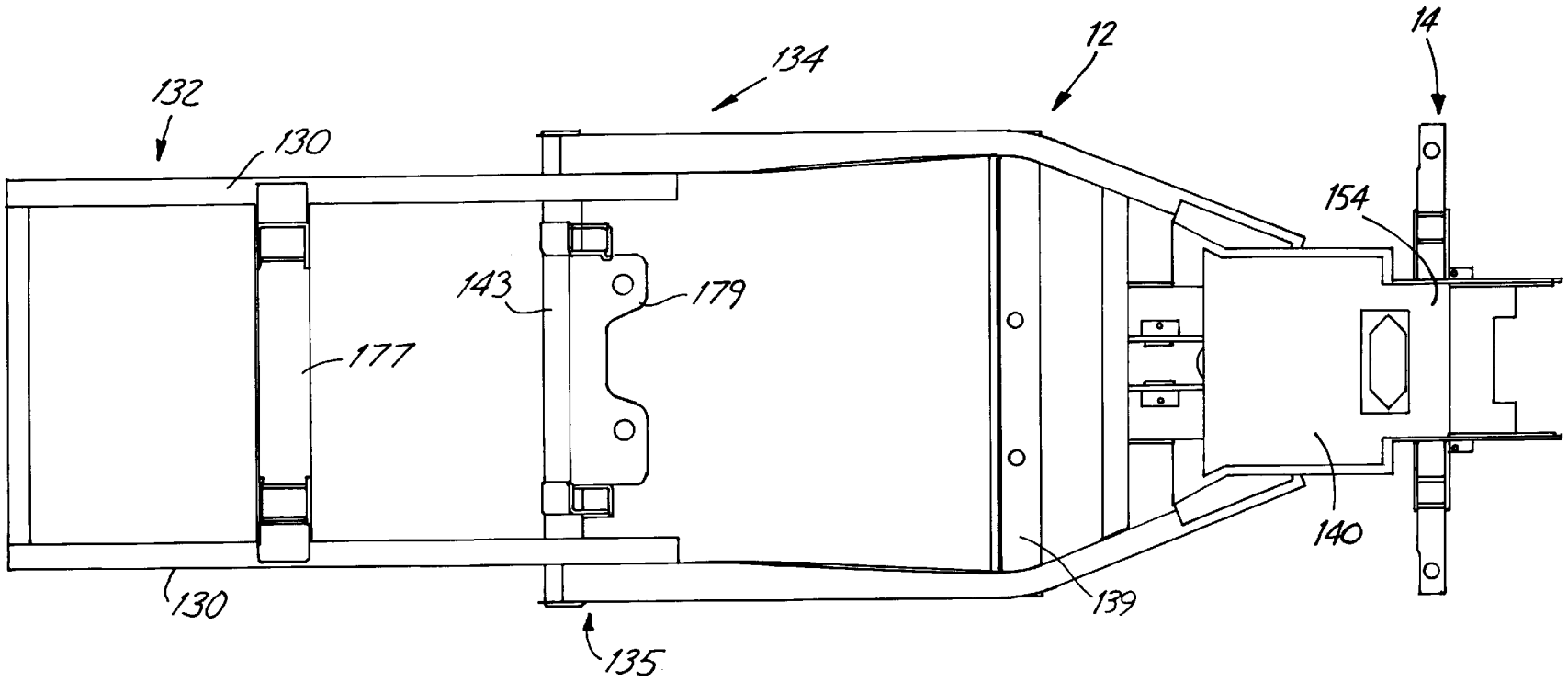
FIG. 10 is a bottom plan view of a frame assembly.

Referring now to FIGS. 5, 9 and 10, the frame assembly 12 is a "rigid" frame assembly wherein no frame articulation is provided between the front wheel assembly 18 and the rear assembly 20. In the embodiment illustrated, the frame assembly 12 includes longitudinal frame members 130 extending from the rear wheel assembly 20 toward the front wheel assembly 18. Generally the frame assembly 12 includes a cargo support portion 132, a middle portion 134 and a front or boom support portion 136. The portions 132, 134, 136 can be attached together as illustrated in FIG. 9 wherein cargo support portion 132 and middle portion 134 are generally attached and defined at connection 135, wherein longitudinal members 130 extend from front to back and are defined by longitudinal sections forming portions 132, 134 and 136. Alternatively, portions 132, 134, 136 may be integral. The cargo support portion 132 and the boom support portion 136 are not as wide as the middle portion 134. The narrower width of the cargo support portion 132 and the front or boom support portion 136 allows for increased pivoting of the wheels 94 for steering of either the front wheel assembly 18 and/or the rear wheel assembly 20. In contrast, the wider transverse width of the middle portion 134 allows accommodation of the transverse oriented engine 24 and provides a stable mount for the operator station 100.

In the embodiment illustrated, the front or boom support portion 136 is particularly strengthened so as to inhibit bending or twisting due to loads carried by the lift arm 34 such as with bucket 36. The front or boom support portion 136 can therefore include a plurality of transverse members 139 extending between the longitudinal members 130, or as illustrated herein, one or more plate members 140 to which the lift cylinder 32 is pivotally connected. An elongated aperture 142 can be provided in an upper plate member 140 as illustrated in FIG. 9 to accommodate pivoting motion of the lift cylinder 32 during operation thereof. Additional support and resistance against twist to the frame assembly 12 can result from a torque tube 143 being provided at or near the connection 135 of middle portion 134 and cargo support portion 132. As described below, transverse members 177, 179 provide support for rear suspension assembly 20.

The support 14 is joined to ends of the longitudinal 130 members and to the transverse ties or the plate members 140 as illustrated in FIGS. 9 and 10. Generally, the support 14 includes side plates 150, an upper back plate 152 and a lower front plate 154, both of which connect the side plates 150 together. An inclined connecting plate 155 can also be provided with an aperture 156 to allow the lift cylinder 34 to extend therethrough. Extending supports 158 can also be provided for support of the operation station 100 on elastomeric isolators, if desired. The operator station 100 can be supported on two additional elastomeric isolators at the rear, if desired. In this manner, the operator station 100 increases the strength of the boom support 14. It should be noted that although direct support for the operator station 100 is provided at supports 158 and at the rear of the frame 20, the operator platform 26 is nevertheless supported by the frame and disposed between the boom support 14 and the cargo support 28. It should be understood that the location of the mounts for operator station 100 and thus the operator platform 26 can occur anywhere on the frame 20.

Referring to FIG. 2, the longitudinal frame members 130 can extend below the operator station 100, and in particular, at a level below an upper surface 160 of the floor panel of the operator station 100 in order to allow easy entry and egress from the operator station 100. As further illustrated, each of the longitudinal frame members 130 can extend upwardly through the middle portion 134 and then over the rear drive assembly 20. In this manner, the operator station 100 and operator platform 26 can be lower so as to allow easy entry into and egress from the operator station 100 and provide a stable platform. Similarly, the front or boom support portion 136 extends at substantially the same level as the portion of the longitudinal frame members 130 below the upper surface 160 of the floor panel. As illustrated, the thickness of the longitudinal frame members 130 for the inclined portions of the middle portion 134 is greater than the thickness of the longitudinal members 130 in the cargo support portion 132 and front or boom support portion 136 so as to concentrate section modulus where needed in order to inhibit bending associating with heavy loads on the remote end of the lift arm 34. Alternatively, front portion 136 and middle portion 134 can be of increased height to concentrate section modulus where needed. Likewise, the height of the longitudinal frame members 130 in the cargo support portion 132 can be similar to the front portion 136 with only the inclined portions of middle portion 134 being of greater height. Although the frame assembly 12 has unique physical characteristics for the reasons discussed above, these physical characteristics can be included in numerous aesthetic designs.

Figure 4:
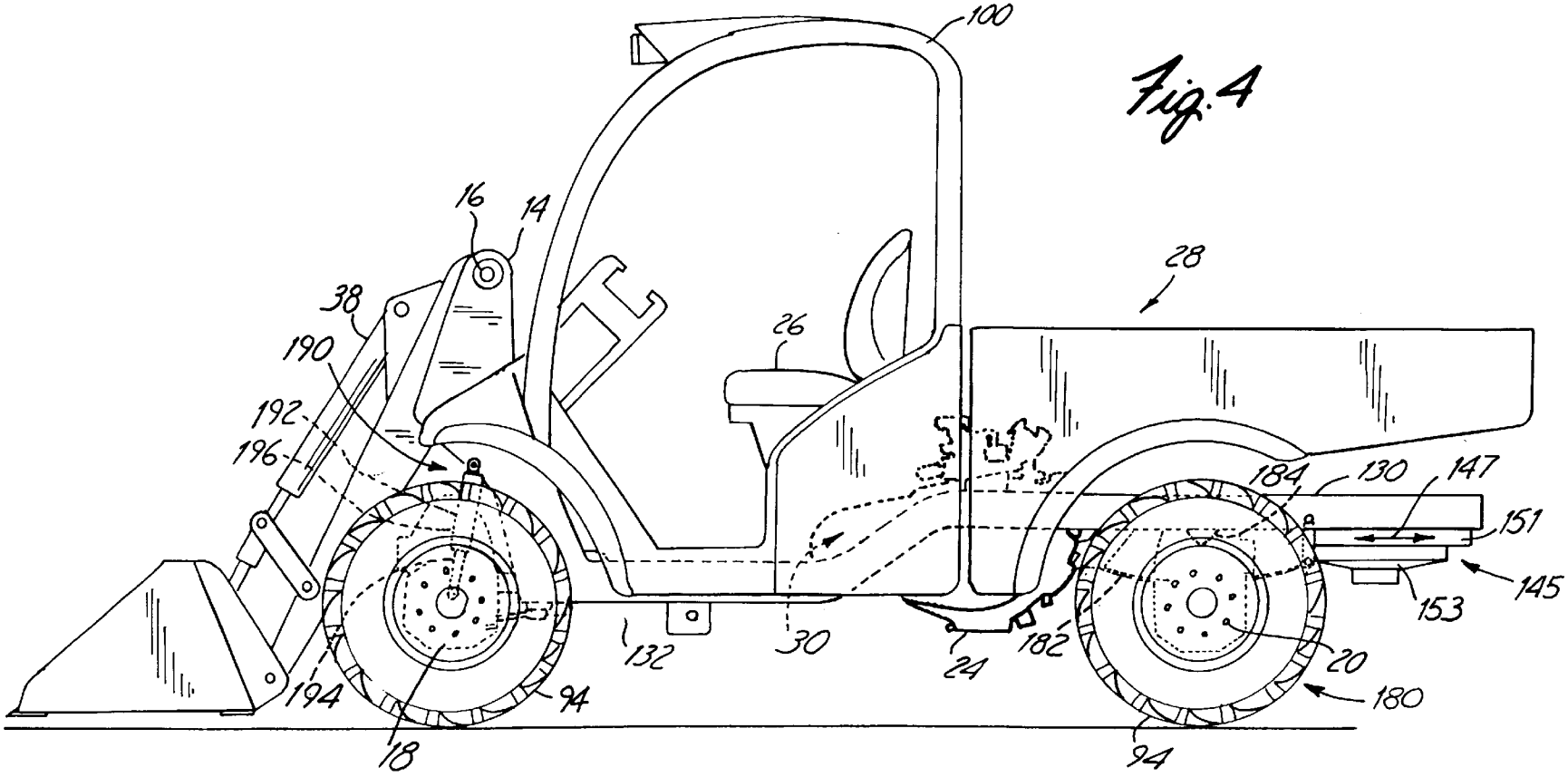
FIG. 4 is a side elevational view of the wheeled work machine with portions shown with dashed lines.
Figure 14:
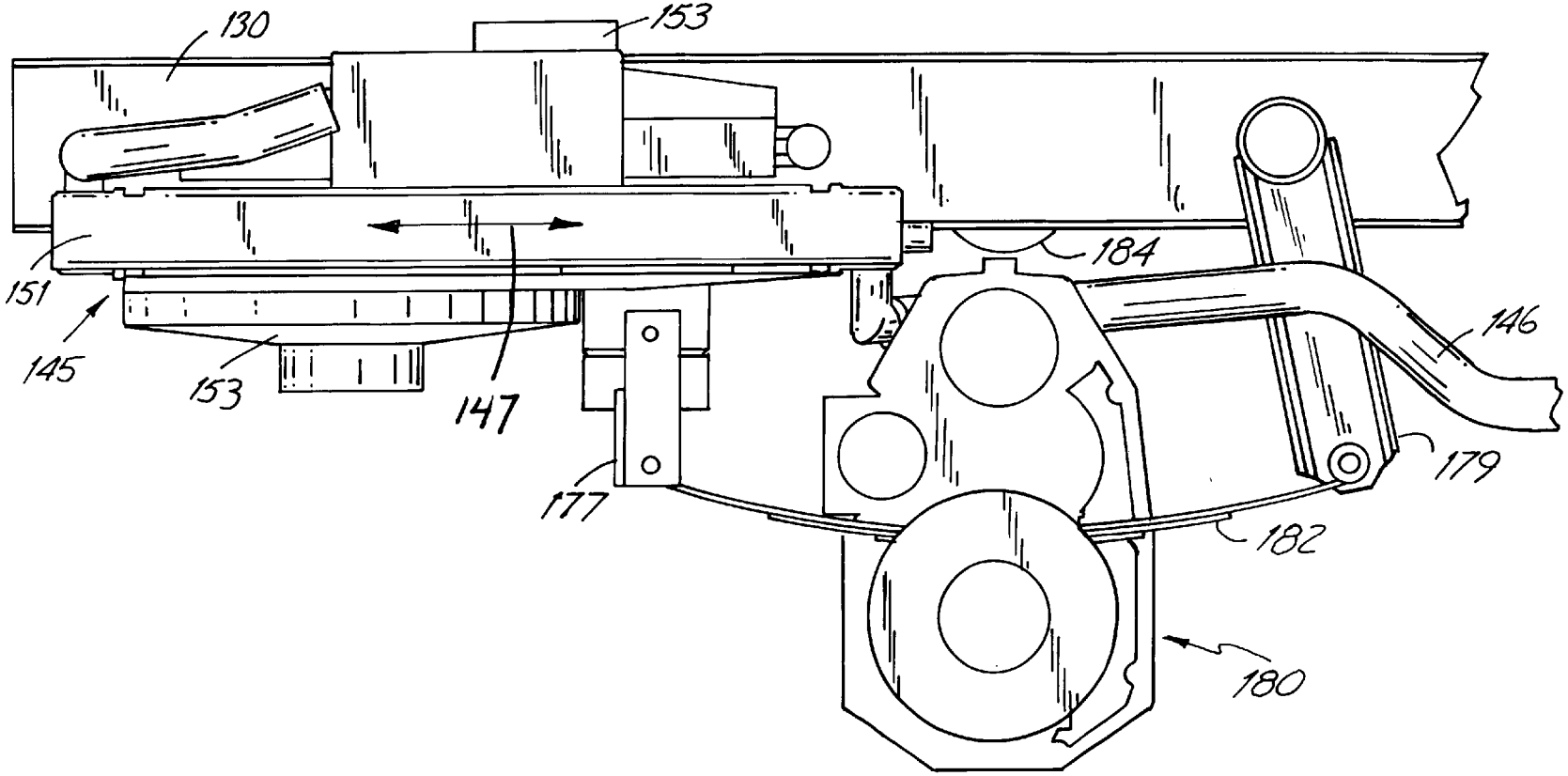
FIG. 14 is a side elevation view of a rear portion of the frame assembly.

In spite of the rigid frame assembly 12 described above, which is well suited for handling loading due to the lift arm 34, each of the wheel assemblies 18 and 20 can further include suspension assemblies allowing the smooth transportation of workers and materials to the job site. Referring to FIGS. 4 and 14, an exemplary suspension assembly 180 for the rear wheel assembly 20 can include a leaf spring or springs 182 connected at remote ends thereof to each of the longitudinal frame members 130. Opposed ends of the rear wheel assembly 20 are joined to a center portion of the leaf spring or springs 182. Leaf spring 182 is supported by members 177, 179 attached to the frame assembly 12. In the embodiment illustrated in FIGS. 9 and 14, member 177 is a transverse bracket extending across the cargo support portion 132, while member 179 is a bracket mounted to torque tube 143. Other suitable suspension elements that can be used include coiled springs, and the like, operably coupled between the rear wheel assembly 20 and the frame members 130.

If further desired, an overtravel assembly 184 can be provided and operable when substantial loads are carried by the work machine 10, for example, on the cargo support 28 when full deflection of the leaf spring or springs 182 is obtained. The overtravel assembly 184 can have a second spring rate stiffer than that of the leaf spring or springs 182 and can be operable only when a selected amount of deflection has been obtained. For instance, the second spring assembly 184 can comprise compressive, elastomeric stops that selectively engage portions of the rear drive assembly 20.

Schematically illustrated in FIG. 4, a suspension assembly 190 for each side of the front assembly 18 can include fluidic dampers 192 joined between the front wheel assembly 18 and the frame assembly 12. Coiled springs can also be provided. The fluidic damper 192 can include fluid chambers formed on opposite sides of a center piston in a suitable cylinder housing 196. Generally, the center piston or piston rod 194 is coupled to one of the front wheel assembly 18 or frame assembly 12, while the cylinder housing 196 is coupled to the other. During transportation to the job site, control valves such as check valves and/or pilot valves can be operated so as to allow fluid flow between the opposed fluidic chambers, wherein the fluid flow is restricted so as to provide damping. However, when it is desired to perform work using the lift arm 34, for example by picking up material with the bucket 36, the control valves for each of the suspension assemblies 198 for the front wheels 94 can be operated so as to substantially inhibit or prevent fluid flow in order to substantially hold the center piston in a substantially fixed position relative to the cylinder housing 196. In this manner, the suspension assemblies 190 are "locked" in order to prevent, or at least substantially inhibit, relative motion between the front wheel assembly 18 and the frame assembly 12. If desired, similar lockable suspension assemblies can also be provided between the frame assembly 12 and the rear wheel assembly 20.

Figure 11:
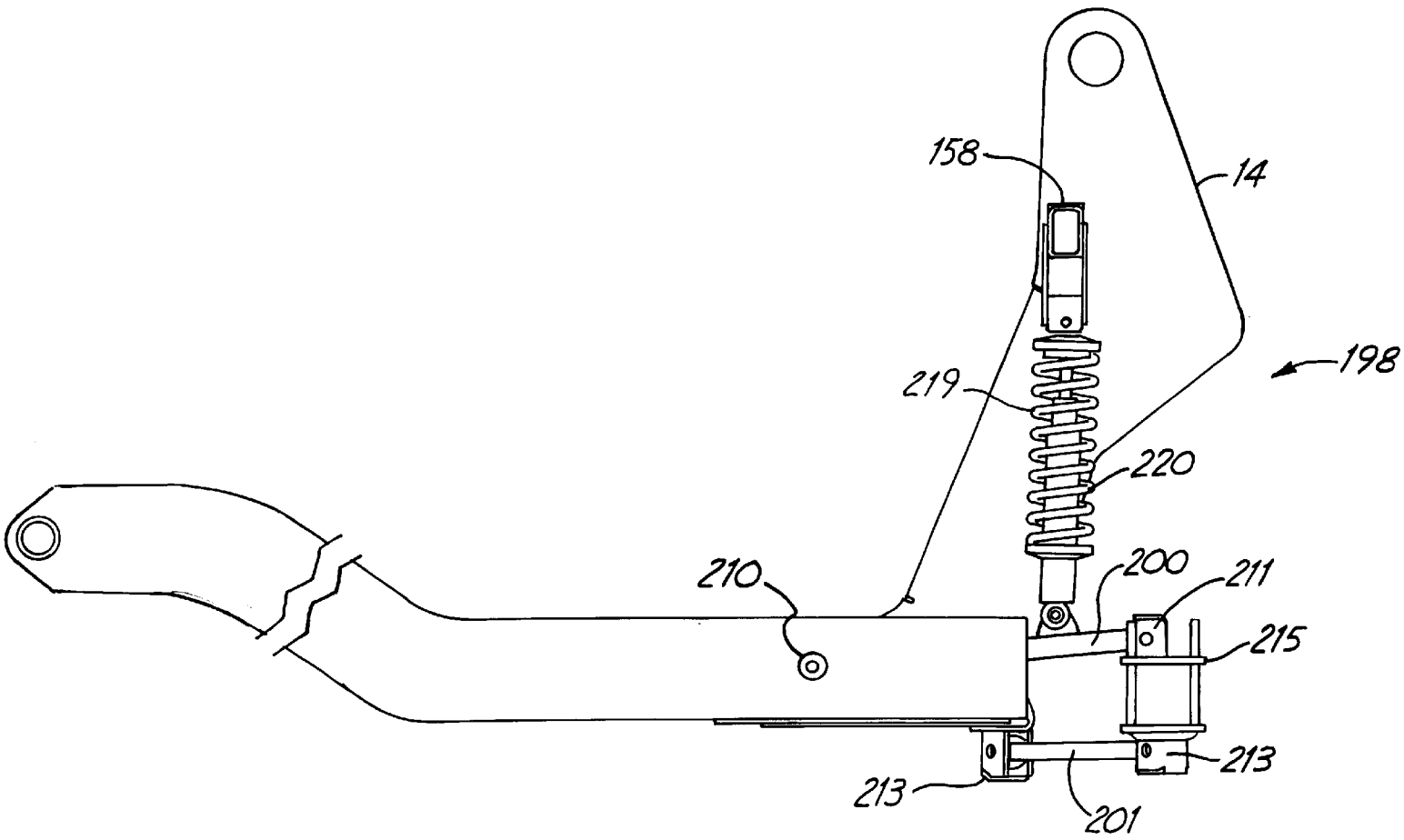
FIG. 11 is a side elevational view of a front suspension.
Figure 12:
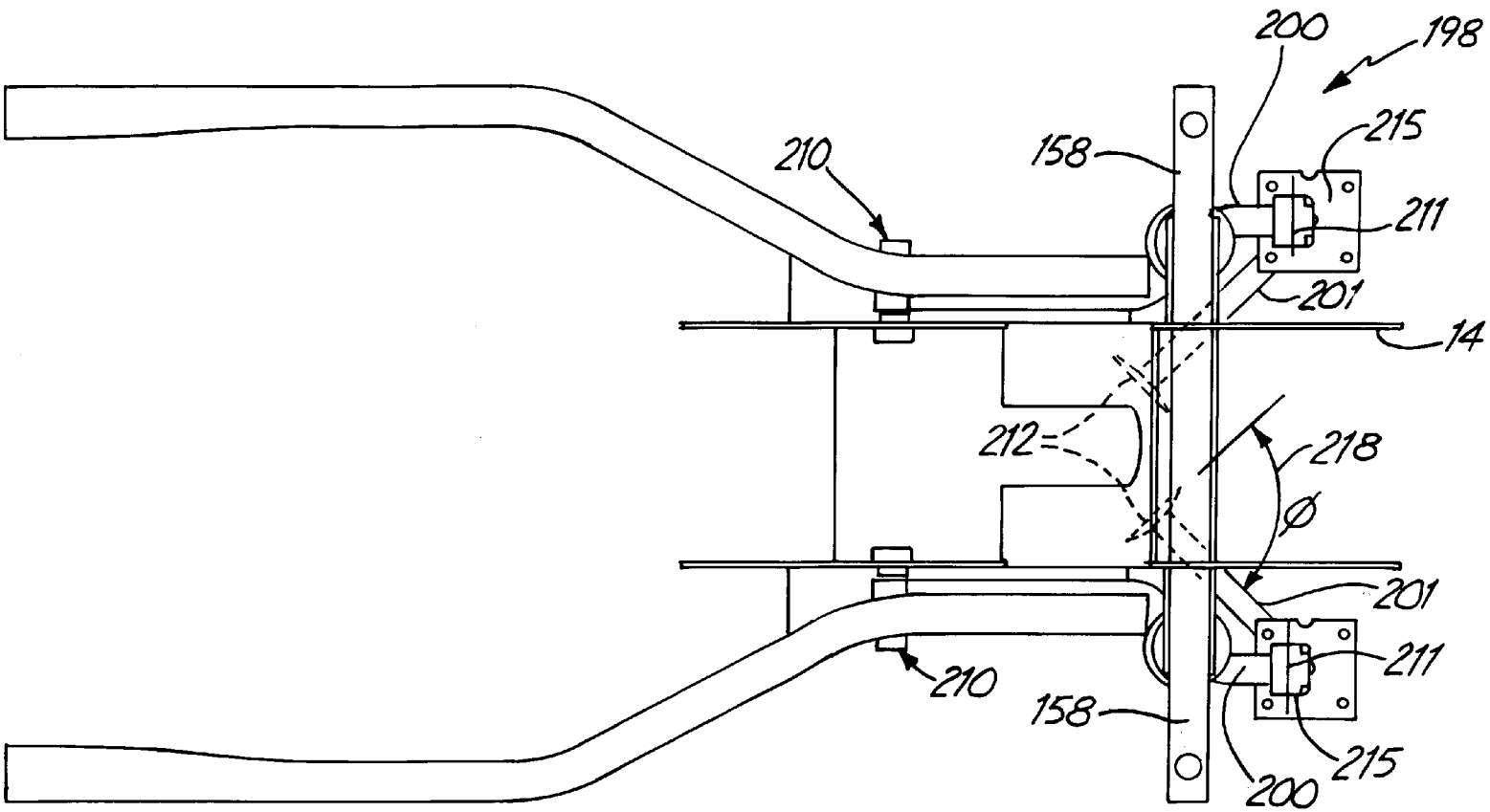
FIG. 12 is a top plan view of the front suspension.
Figure 13:
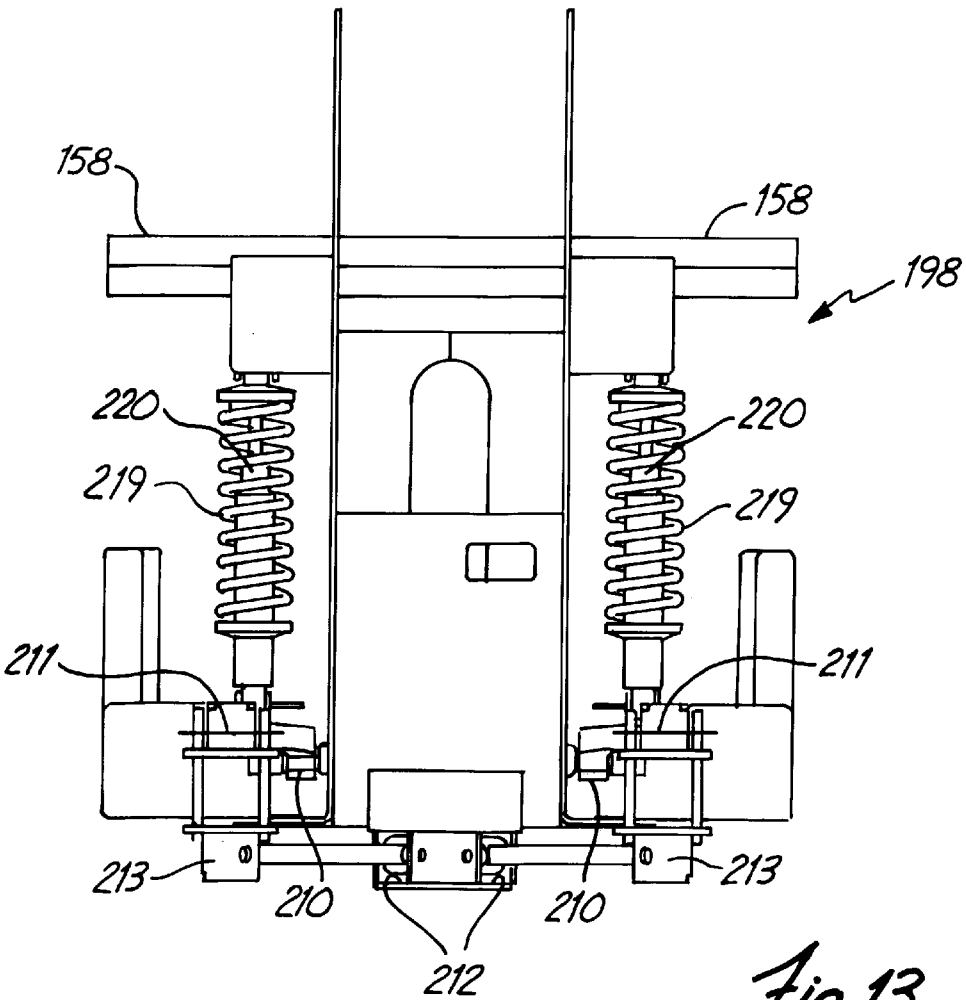
FIG. 13 is a front elevational view of the front suspension.

FIGS. 11, 12 and 13 illustrate a front suspension assembly 198. The front suspension assembly 198 includes on each side of the frame 20 an upper link 200 and a lower link 201 that are used to control the location of the corresponding drive shaft or axle 88 relative to the frame 20. Pivot mounts 210 are provided on the frame 20 and on axle supports 215 at 211 for each of links 200. These pivots are parallel to each other and perpendicular to the longitudinal axis of the frame 20. Pivot mounts 213 are provided on the frame 20 and on the supports 215 for each of links 201. Supports 215 are connected to ends of the drive housing assemblies 84. An oblique angle 218 formed between lower link 201 and the longitudinal axis of the vehicle is set to provide lateral stability to the driving house 84 and still offer a defined range of motion for the axle. For example, the angle 218 can be 45 degrees. The geometry of the links 200 and 201 controls rotation of axles throughout its vertical movement due to input into the suspension system 198. Coils 219 over shocks 220 or the fluidic dampers 192 mount to the drive housing 84 and pivot connections are provided on the boom support 14. The coils 219 allow the suspension to respond to input loads to the work machine either through the wheels 94 or the loader arm 34 or a combination of the two. It should be noted a torsion spring can be provided at each of the pivots 210 in the alternative or in addition to the coils 219.

The arrangement of the links 200 and 201 maintains the front wheel assembly 18 position under the front of the machine by working to inhibit any fore-to-aft or side-to-side movement. The geometry of the links 200 and 201 allows primarily rotational motion of the front wheel assembly 18 and provides for suspension travel.

Although the present invention has been described with reference to preferred embodiments, workers skilled in the art will recognize that changes may be made in form and detail without departing from the spirit and scope of the invention.

What is claimed is:

1. A wheeled work machine, comprising:

a rigid frame assembly having a stationary and approximately vertical upstanding support with a remote upper end, the support having a boom pivot proximate the upper end;

a downward and forward extending lift arm pivoting about the boom pivot;

a front wheel assembly joined to the frame assembly proximate the support;

a rear wheel assembly joined to the frame assembly at an end remote from the support;

an engine mounted to the frame assembly;

an operator platform supported by the frame assembly and positioned between the boom pivot and the engine; and a cargo support supported by the frame assembly behind the operator platform.

2. The wheeled work machine of claim 1 wherein the front wheel assembly includes steerable wheels.

3. The wheeled work machine of claim 2 and further comprising a steering wheel disposed proximate the operator platform and coupled to wheel hubs of the front wheel assembly.

4. The wheeled work machine of claim 1 wherein the rear wheel assembly includes steerable wheels.

5. The wheeled work machine of claim 4 and further comprising a steering wheel disposed proximate the operator platform and coupled to wheel hubs of the rear wheel assembly.

6. The wheeled work machine of claim 1 and further comprising a lift cylinder operably coupled to the lift arm and the frame assembly.

7. The wheeled work machine of claim 1, wherein the rigid frame assembly further comprises a pair of spaced apart longitudinal members with transverse ties, the longitudinal members defining a cargo support portion at one end thereof and a front portion at an end remote from the cargo support portion, and a middle portion disposed between the cargo support portion and the front portion, the middle portion having a transverse width greater than at least one of the cargo support portion and the front portion wherein the support is joined to the front portion.

8. The wheeled work machine of claim 6 wherein a minimum angle formed between the boom pivot and a second pivot at a remote end of the lift arm and a normal reference line from the boom pivot to a level ground surface is in the range of 20 to 35 degrees.

9. The wheeled work machine of claim 6 wherein the lift cylinder is coupled to the frame assembly between the front wheel assembly and the rear wheel assembly.

10. The wheeled work machine of claim 6 and further comprising:

an interface member pivotally joined to an end of the lift arm remote from the boom pivot; and a tilt cylinder operably coupled between the lift arm and the interface member.

11. The wheeled work machine of claim 10 wherein the interface member includes a locking device on each side of the lift arm, each locking device comprising a pivotable lever coupled to a slidable member with a spring.

12. The wheeled work machine of claim 1 wherein the operator platform is disposed in an operator station joined to the frame assembly, the operator station allowing entry into and egress out of the operator platform between the front and rear wheel assemblies on at least one side of the work machine.

13. The wheeled work machine of claim 12 wherein the operator platform includes two side by side seating positions.

14. The wheeled work machine of claim 12 wherein the frame assembly includes longitudinal frame members extending from the rear wheel assembly toward the front wheel assembly.

15. The wheeled work machine of claim 14 wherein a transverse width between the longitudinal frame members is greater under the cab than under the cargo support area.

16. The wheeled work machine of claim 14 wherein the frame assembly includes a plate member extending between the longitudinal frame members below a floor panel of the operator platform.

17. The wheeled work machine of claim 14 wherein each longitudinal frame member includes a first portion disposed below the cargo support area, a second portion proximate the support and below a level of the operator platform and an inclined portion extending downwardly from the first portion and joining the first portion to the second portion.

18. The wheeled work machine of claim 1 and further comprising a link assembly joining the front wheel assembly to the frame, the link assembly comprising a pair of lower links pivotally joined to the frame and each end of the front wheel assembly and oriented obliquely with respect to a longitudinal axis of the frame and a pair of upper links pivotally joined to the frame and each end of the front wheel assembly.

19. The wheeled work machine of claim 1 and further comprising:

a lift cylinder operably coupled to the lift arm and the frame assembly; and an instrument cluster in front of the operator platform and behind the boom pivot, the instrument cluster disposed on the operator platform at a level to allow an operator of height in the range of a female in the fifth percentile to a male in the ninety-fifth percentile to view an end of the lift arm remote from the boom pivot.

20. The wheeled work machine of claim 1 and further comprising a hydraulic pump coupled to the engine and wherein at least one of the front and rear wheel assemblies includes a hydraulic drive motor operably coupled to the hydraulic pump.

21. The wheeled work machine of claim 20 wherein the front wheel assembly includes a common hydraulic motor coupled to the hydraulic pump, the hydraulic motor including output shafts extending in opposite directions.

22. The wheeled work machine of claim 20 wherein the rear wheel assembly includes a common hydraulic motor coupled to the hydraulic pump, the hydraulic motor including output shafts extending in opposite directions.

23. The wheeled work machine of claim 20 and further comprising auxiliary hydraulic couplings disposed at a front end of the work machine, the auxiliary hydraulic couplings being fluidly coupled to the hydraulic pump.

24. The wheeled work machine of claim 1 wherein the engine includes a crankshaft, the crankshaft being transversely oriented relative to side portions of the frame assembly.

25. The wheeled work machine of claim 1 wherein the operator platform is disposed between the front wheel assembly and the rear wheel assembly.

26. The wheeled work machine of claim 1 wherein the cargo support comprises a cargo box.

27. The wheeled work machine of claim 1 wherein the cargo support comprises a sprayer.

28. The wheeled work machine of claim 1 wherein the cargo support comprises a hopper.

29. The wheeled work machine of claim 1 wherein the rear wheel assembly includes a suspension assembly on each side of the frame assembly, each suspension assembly coupling the rear wheel assembly to the frame assembly.

30. The wheeled work machine of claim 29 wherein each of the suspension assemblies comprise a leaf spring.

31. The wheeled work machine of claim 30 wherein each of the suspension assemblies include a secondary spring element which are operable upon selected deflection of the corresponding leaf spring.

32. The wheeled work machine of claim 1 wherein the operator platform comprises a seat.

33. The wheeled work machine of claim 1 wherein the cargo support is disposed over at least a portion of the engine.

34. The wheeled work machine of claim 7 wherein the middle portion has a transverse width greater than both the cargo support portion and the front portion.

35. The wheeled work machine of claim 7 wherein portions of the longitudinal members forming the front portion are offset from portions of the longitudinal members forming the cargo support portion with an inclined portion disposed therebetween in each longitudinal member.

36. The wheeled work machine of claim 35 wherein the inclined portion of each longitudinal member is closer to the cargo support portion than the support.

37. The wheeled work machine of claim 36 wherein a section modulus of the longitudinal member comprising the inclined portion is greater than a section modulus of each portion of the corresponding longitudinal member comprising the cargo support portion and the front portion.

38. The wheeled work machine of claim 36 wherein the front portion includes a plate member joining the longitudinal members together.

39. The wheeled work machine of claim 38 and further comprising a lift cylinder joined to the plate member at one end and the lift arm at the other end, the lift cylinder extending through an aperture in the support.

40. The wheeled work machine of claim 39 wherein the plate member includes an aperture through which the lift cylinder extends.

41. The wheeled work machine of claim 7 and further comprising a lift cylinder joined to the front portion at one end and the lift arm at the other end, the lift cylinder extending through an aperture in the upstanding support.

42. The wheeled work machine of claim 7 wherein one of the transverse ties is a torque tube located proximate a connection of the cargo support portion and the middle portion.

* * * * *